United States Patent [19]

von Starck et al.

[11] 4,256,165

[45] Mar. 17, 1981

[54] STIRRING OF MOLTEN METAL CORE IN A CASTING AS WITHDRAWN FROM A MACHINE FOR CONTINUOUS CASTING

[75] Inventors: Axel von Starck, Remscheid; Hans E. Gerbig, Hückeswagen-Wiehagen; Hans Schrewe, Duisburg; Jürgen Sardemann, Essen; Josef Glaser, Düsseldorf, all of Fed. Rep. of Germany

[73] Assignees: Mannesmann Aktiengesellschaft, Dusseldorf; AEG-Elotherm GmbH, Remscheid, both of Fed. Rep. of Germany

[21] Appl. No.: 52,218

[22] Filed: Jun. 26, 1979

[30] Foreign Application Priority Data

Jun. 23, 1978 [DE] Fed. Rep. of Germany ..... 2828160

[51] Int. Cl.[3] ..... B22D 27/02; B22D 11/10; B22D 45/00

[52] U.S. Cl. ..... 164/147; 164/251

[58] Field of Search ..... 164/49, 147, 250, 82, 164/50, 251, 415, 263, 417, 146, 442, 448, 441, 447

[56] References Cited

U.S. PATENT DOCUMENTS

| | | | |
|---|---|---|---|
| 3,177,536 | 4/1965 | Schneider | 164/250 X |
| 3,952,791 | 4/1976 | Ito et al. | 164/49 |
| 4,015,656 | 4/1977 | Scheinecker et al. | 164/441 |

FOREIGN PATENT DOCUMENTS

| | | | |
|---|---|---|---|
| 1233109 | 1/1967 | Fed. Rep. of Germany | 164/263 |
| 2134858 | 1/1973 | Fed. Rep. of Germany | 164/263 |
| 1597257 | 7/1970 | France | 164/49 |
| 2383734 | 11/1978 | France | 164/263 |
| 442886 | 6/1975 | U.S.S.R. | 164/147 |

*Primary Examiner*—Robert D. Baldwin
*Assistant Examiner*—Gus T. Hampilos
*Attorney, Agent, or Firm*—Smyth, Pavitt, Siegemund, Jones & Martella

[57] ABSTRACT

One or more electromagnetic stirring elements are mounted on arms and/or holders, extending from a carriage which runs on a stationary bed and in a direction transversely to the direction of casting. The stirring elements are either directly positioned in the direction of carriage movement or orthogonally thereto. Multiphase elements can be positioned from three different directions to circumscribe the casting.

10 Claims, 5 Drawing Figures

STIRRING OF MOLTEN METAL CORE IN A CASTING AS WITHDRAWN FROM A MACHINE FOR CONTINUOUS CASTING

BACKGROUND OF THE INVENTION

The present invention relates to electromagnetically stirring molten metal in a machine for continuous casting.

Generally speaking, stirring and-here particularly-electromagnetic stirring of the not yet solidified metal in a casting is a common expedient. Stirring the interior of the casting is used to enhance the cooling and solidification process and to impede organized solidification and formation of unwanted texture in the crystallization. Moreover, upon stirring one can expect reduced liquation of additives and reduced porosity of the core of the casting as it is about to be established.

The devices used for stirring the still molten metal in a casting are either placed alongside the casting as withdrawn from a mold, or the stirring devices circumscribe this casting. It will be appreciated that for the purpose of adequate and efficient electrical coupling, one has to place the stirring device, i.e., the electromagnetic energizing means, as close to the surface of the casting as possible.

The stirring devices referred to above are, necessarily, part of the equipment and machine to be installed before casting begins. Moreover, the requisite proximity to the casting requires that the position of the stirring device must be rather accurately predetermined and set in relation to the mold cavity. This means that the stirring device as mounted in the machine is directly tied to the format and cross section of the casting. A different mold and, particularly, a differently contoured and dimensioned mold cavity in the same machine requires a completely new installation of the stirring device, particularly if placed alongside the casting. A stirring device that circumscribes the casting is actually designed and rated for one type of casting as far as dimensions are concerned and may not be usable at all for other casting dimensions.

DESCRIPTION OF THE INVENTION

It is an object of the present invention to provide a new and improved electromagnetic stirring device for continuous casting machines, which device does not have the limitations outlined above.

It is a specific object of the present invention to provide a new and improved stirring device for a machine for continuous casting in which machine the casting is withdrawn along a withdrawal path in a particular withdrawal direction of casting.

In accordance with the preferred embodiment of the present invention, it is suggested to provide a stationary bed and a carriage means which runs on the bed in a direction transversely to the direction of movement and withdrawal of the casting as per the specific object.

The electromagnetic stirring device (or devices) is (or are) mounted on the carriage in overhung relationship to be placed in close proximity to the casting. The carriage means may have additional mounting means, permitting adjustment of the stirring device in a third orthogonal direction. The invention is suitable for placing a single electromagnetic stirring device in close proximity to the casting, but one may also use sectional stirring devices for multiphase operations and circumscribing the casting. The individual device elements are then separately mounted and separately adjustable.

It can thus be seen that the stirring device, in accordance with the preferred embodiment, can be adjusted to different size and differently contoured castings, or is even retracted completely if for any reason stirring is not desired. The retractability facilitates greatly maintenance, repair, and exchange of the several parts, even while casting continues.

The preferred embodiment of the invention, the objects and features of the invention and further objects, features, and advantages thereof will be better understood from the following description taken in connection with the accompanying drawings.

Figure 1:
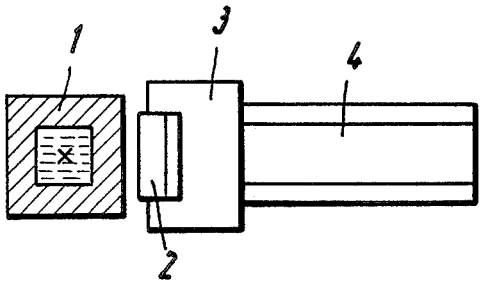
FIG. 1 is a top view of an example in accordance with the preferred embodiment, showing also a cross section through a casting.

Proceeding now to the detailed description of the drawings, all Figures show a metal casting 1, e.g., steel, resulting in an ingot of square-shaped cross sections. The section is taken in each instance at a location downstream from the mold, but sufficiently close thereto as the interior of the casting is still in the molten state. The center X represents the direction of casting in the plane of the drawing.

FIG. 1 shows an electromagnetic structure or element 2 of conventional design which, when placed sufficiently close to casting 1, will cause the molten interior thereof to move, to thereby provide stirring action to and of the not yet solidified metal.

The electromagnetic stirrer is mounted on a holder 3 which, in this example, is directly constructed as a carriage. This carriage can be moved on a stationary support constructed as a rail bed 4. Bed 4 may be constructed as a stationary frame with rails or similar guide elements on which holder/carriage 3 can run.

The rail or frame 4 does not extend all the way to the area to be occupied by casting 1 because the dimensions of the latter may change. Thus, carriage 3 is of the overhung variety, permitting the stirring element 2 to be placed as close as necessary to casting 1. If the dimensions of the casting change, it may merely be necessary to advance or retreat devices 2 and 3. Also, during startup, mold changes, maintenance, etc., one will retract device 2 on carriage 3 to facilitate access.

The stirring device must be electrically insulated from the casting as direct conduction of current is not desired. Since the metal being cast is necessarily in contact with the mold, and since the mold is usually made (at least in parts) from copper, one really has to insulate the stirring device from from the casting machine as a whole. Thus, one may make either bed 4 or carriage/holder 3 from insulating material, or provide at least insulation between them and the foundation.

Figure 2:
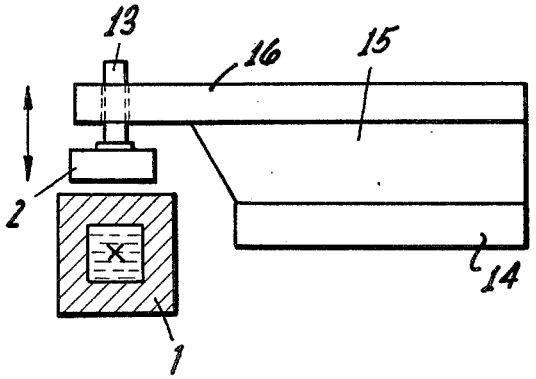
FIGS. 2 and 3 are views similar to FIG. 1, showing modified examples of the preferred embodiment.

FIG. 2 shows also a casting 1 and a stirring element 2. This electromagnetic element is mounted here on the front end of a spindle 13 by means of which element 2 (possibly without turning, there being suitable bearings) can be advanced towards or retracted from the casting.

Spindle 13, holding, carrying, and positioning the stirring element, is held on an arm 16 or a carriage 5 which, in turn, can slide on a bed 14. Thus, and as indicated by the two arrows, stirring element 2 can be laterally displaced and retracted, or otherwise positioned, in the one direction of carriage movement and in an orthogonal direction, towards and away from the casting axis, i.e., the two adjusting positions are both orthogonal or transverse to each other and to the axis and direction of casting.

In order to facilitate putting the device into operation, arm 16 may be provided with suitable adjustable stops, cooperating with a stop on element 2 or its immediate holder, so that for any given dimension of the casting, the spindle needs to be adjusted just until the stops engage.

Figure 3:
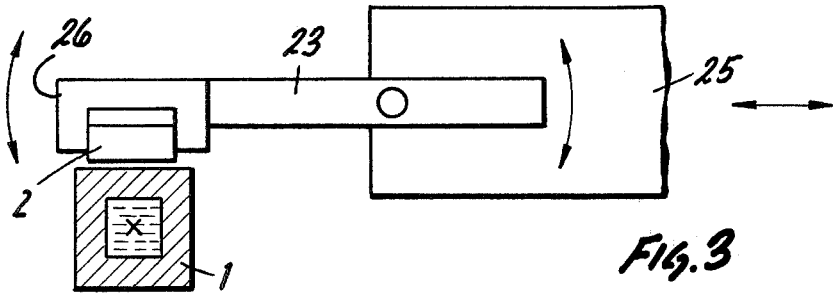

FIG. 3 illustrates also a carriage 25 being movable on rails and carrying a pivot arm 23 extending laterally to and from the casting. One end of arm 23 carries a holder 26 which, in turn, holds stirring element 2 in a suitable position in relation to casting 1. Stirring element 2 is thus also in this example moved transversely to the carriage movement. The stops for adjustment and positioning element 2 exactly as required may be provided inside the carriage in this case.

Figure 4:
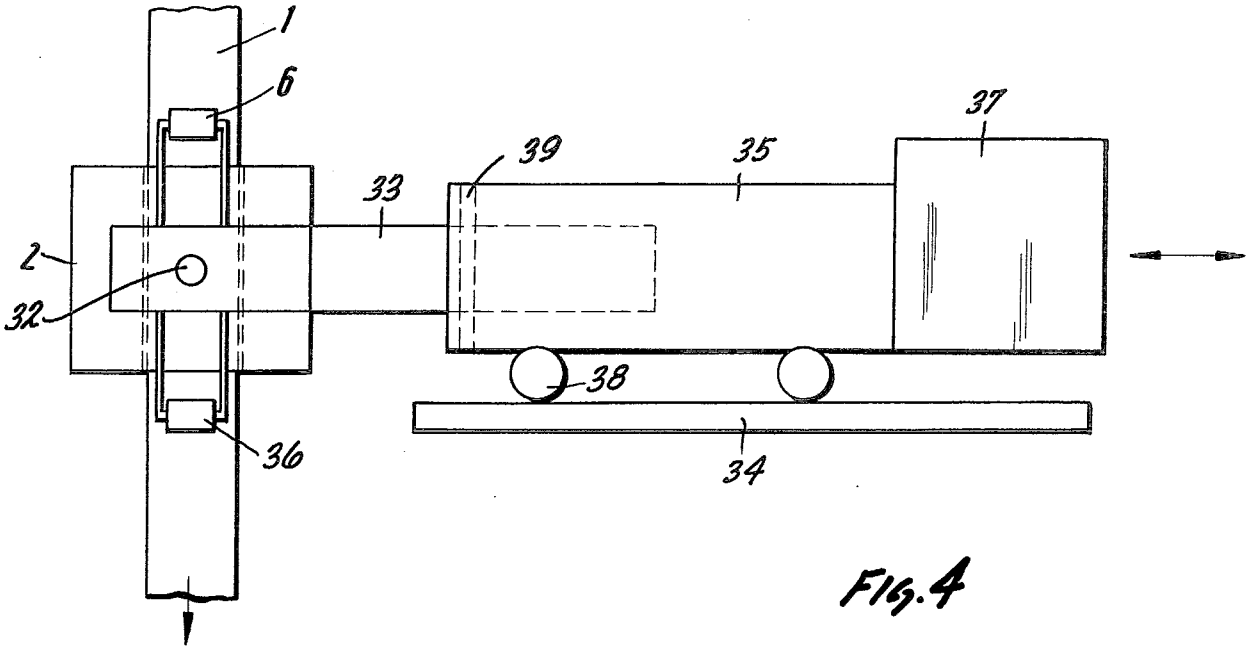
FIG. 4 is a side view of another device in accordance with the preferred embodiment.

FIG. 4 illustrates a positioning device in somewhat greater detail, but following the basic concepts particularly of FIGS. 1 and 2. FIG. 4 shows a rail 34 as stationary base and support on which runs a carriage 35 having rolls 38. An arm 33 extends from carriage 35, pertaining thereto. Arm 33 may be pivoted in carriage 35 by means of a pivot pin or bolt 39. Stirring element 2 is mounted to the one, external, end of that arm which extends beyond rail 34.

A spindle 32 is used to place stirring device 2 closer to, or farther from, casting 1 as a fine position adjustment. In addition, loops are mounted on arm 33 to journal guide rollers 36 which engage the casting and thus position device 2 as positive relation to the outer surface of the casting.

The rear of carriage 35 carries equipment 37 which will include the requisite drive means such as an electromotor by means of which spindle 32 can be turned, arm 33 be pivoted, and the carriage be moved on the track. Also, equipment 37 will include cooling means to cool down the equipment as the influx of heat from the solidifying ingot and casting is quite significant.

Moreover, device 37 serves as a counterweight for the overhung front portions. Device 37 may include additional weights to balance the carriage as a whole.

Conveniently, rolls 38 may be made of electrically insulating material, and/or rails 34 may be so constructed or mounted.

Figure 5:
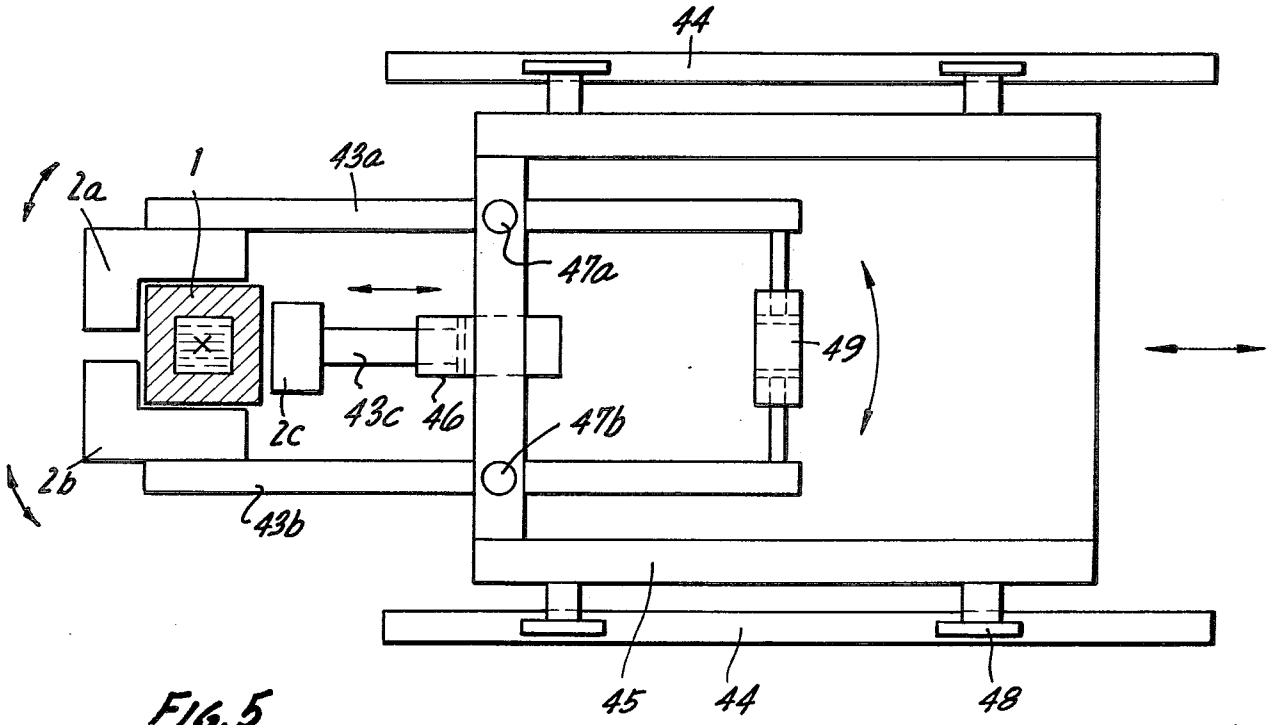
FIG. 5 is a top view similar to FIGS. 1, 2, and 3, but showing an example of a circumscribing stirring device in accordance with the preferred embodiment.

FIG. 5 illustrates a three-phase stirring equipment having three electromagnetic devices 2*a*, 2*b*, and 2*c*, which together circumscribe the casting but for the requisite gaps. The equipment includes additionally a pair of pivoting arms 43*a* and 43*b*, respectively carrying devices 2*a* and 2*b* and being pivoted by a hydraulic device 49. A third, relatively short, arm 43*c* is provided to hold electromagnetic device 2*c*.

Arms 43*a* and 43*b* are pivoted on a frame 45 by means of pivots 47*a* and 47*b*, respectively. The frame is also constructed as a carriage, having wheels 48 and running on rails 44. Arm 43*c* is the piston rod for another hydraulic actuator 46 on the frame and carriage 45.

It can thus be seen that the hydraulic actuator 9 causes arms 43*a* and 43*b* to spread in order to recede from and clear the casting, whereupon carriage 45 can be retracted For positioning, one reverses the movement, and piston drive 46 will fine-position the third energizing element, 2*c*, for the stirrer.

Also in this example, rollers on wheels 48 may be made of insulating material, and/or frame 45 and/or rails 44.

This particular example is shown to be provided with hydraulic actuators for positioning and retracting the several electromagnetic stirring elements. Instead, one could use electromagnetic actuators such as servomotors, solenoids, etc. Any one of the adjustment movements described above can be so carried out. One can also use pneumatic or mechanical actuators.

The invention is not limited to the embodiments described above, but all changes and modifications thereof not constituting departures from the spirit and scope of the invention are intended to be included.

We claim:

1. An electromagnetic stirring device in a machine for continuous casting, wherein a casting in to be withdrawn from the machine along a withdrawal path in a particular withdrawal direction, comprising in combination:

stationary support means, including horizontal rail means extending generally toward the withdrawal path of the casting in a direction transverse to the particular withdrawal direction;

carriage means for running on the rail means of the support means in the said transverse direction; and at least one electromagnetic stirring element mounted on the carriage means and in overhanging relation to a front part of the carriage means for extending beyond a front portion of the rail means, the stirring element being provided for being positioned in adjustable proximity to said casting.

2. A stirring device as in claim 1, there being additional mounting means on the carriage and providing said overhanging relation, the stirring element being mounted on the mounting means for additional position adjustment of the stirring element on the carriage means.

3. A stirring device as in claim 2, the mounting means extending lateral to the withdrawal path of the casting, so as to bypass the withdrawal path of the casting, as the carriage is positioned toward the withdrawal path of the casting, the stirring element being mounted for the additional adjustment to be carried out in a direction directly toward the withdrawal path of the casting, transverse to said direction of running and to the particular withdrawal of the casting direction.

4. A stirring device as in claim 2, the mounting means being a pivot arm, extending laterally, so as to bypass the casting as the carriage is positioned toward the casting, the pivoting being carried out on an axis parallel to the particular direction.

5. A stirring device as in claim 4, there being an additional, fine adjustment spindle for mounting the stirring element to the pivot arm.

6. A stirring device as in claim 1, including a plurality of stirring elements being mounted on the carriage means for individual adjustment transverse to the particular withdrawal direction.

7. A stirring device as in claim 1, and including guide rolls on the carriage means for engagement with the casting to thereby position the electromagnetic means in relation to the withdrawal path of the casting.

8. A stirring device as in claim 1, and including counterweight means on the carriage means.

9. A stirring device as in claim 1, including two stirring elements mounted separately on arms being pivoted on the carriage, the arms for extending along opposite sides of the withdrawal path of the casting, the arms pivoting in opposite directions for moving the stirring elements toward and away from each other.

10. A stirring device as in claim 9, including a third stirring element mounted on a reciprocating arm on the carriage and extending therefrom, in between the pivoting arms.

* * * * *